United States Patent [19]

Chang et al.

[11] Patent Number: 4,945,596

[45] Date of Patent: Aug. 7, 1990

[54] GOLF BALL, GOLF CLUB AND GOLF SHOE SCRUBBER

[76] Inventors: Daniel G. Chang; Regina L. Urbantas, both of 680 Queen's Quay W., Suite 611, Toronto, Ontario, Canada M5V 2Y9; Richard G. Urbantas, 104 Grant Ave., Hamilton, Ontario L8N 2X7, Canada

[21] Appl. No.: 260,465

[22] Filed: Oct. 20, 1988

[51] Int. Cl.[5] ..... A63B 47/04

[52] U.S. Cl. ..... 15/21.2; 15/104.92; 15/160

[58] Field of Search ..... 15/21 A, 97 R, 104.92, 15/160

[56] References Cited

U.S. PATENT DOCUMENTS

| | | | |
|---|---|---|---|
| 3,101,497 | 8/1963 | Derkocz | 15/21 A |
| 3,271,802 | 9/1966 | Thompson | 15/21 A |
| 3,583,016 | 6/1971 | McConnell | 15/21 A |
| 3,678,526 | 7/1972 | Burkholder | 15/21 A |
| 4,750,232 | 6/1988 | Doney | 15/21 A |

*Primary Examiner*—Edward L. Roberts

*Attorney, Agent, or Firm*—Blake, Cassels & Graydon

[57] ABSTRACT

This invention provides the golfer with a golf ball and golf club scrubber combination which also cleans golf shoe cleats and soles, and which is portable, and clips on the golf bag or cart. The present invention comprises basically a cylindrical body, cylindrical at the upper portion and tapers at the lower portion to form an elliptically-shaped closed bottom. A threaded top or cap seals the body which also holds within it a pair of scrubbing brushes. Through the center of the cap extends a handle, threaded plunger and retaining cage assembly which permits a golf ball to be easily and effectively scrubbed and washed clean with vertical movement of the handle assembly. The scrubbing brushes, immersed in the cleaning solution, are easily removed from the body to scrub and clean golf clubs, golf shoe cleats and soles. This invention allows easy scrubbing of the golf ball without any splashing of the said solution on the golfer, golf bag or cart and, when not in use, is transportable without leaking or spilling of said solution regardless of the position of the scrubber.

5 Claims, 6 Drawing Sheets

GOLF BALL, GOLF CLUB AND GOLF SHOE SCRUBBER

The present invention generally relates to a ball, club and shoe scrubber and more particularly to a golf ball scrubber and golf club scrubber and golf shoe cleats and sole scrubber.

The said present invention was principally engineered to provide the golfer a convenient and aesthetically designed golf ball, golf club and golf shoe cleats and sole scrubber which can be conveniently carried or transported by the golfer so as to be readily available at all times.

Another important object of this invention is the provision of the golf ball, golf club and golf shoe scrubber which can be quickly slipped and secured on to the body of the golf bag, or golf cart or motorized golf cart or golf vehicle in a variety of positions to be quickly and easily accessible when required by the golfer. The golfer can quickly reposition the golf ball, golf club and golf shoe scrubber to the various locations without using any tools or hardware.

Another important object of the golf ball, golf club and golf shoe scrubber is the provision which can contain water, detergent or cleaning solution within its body without leaking or spilling the said solution regardless of the position of the scrubber.

Another important object of the golf ball, golf club and golf shoe scrubber is the provision which is a retaining cage which can secure the golf ball within it and allows the golf ball easy movement within the cage during the scrubbing and cleaning process and allows easy access to place or remove the golf ball from the cage when the scrubbing and cleaning process is completed.

Another important object of the golf ball, golf club and golf shoe scrubber is the provision which quickly seals the golf ball within the watertight body by securing the top or cap to the main body and then scrubs the golf ball without any splashing of the said solution on the golfer or golf bag, cart or golf vehicle.

Another important object of the golf ball, golf club and golf shoe scrubber is the provision of means for scrubbing and cleaning the golf ball by vertical manipulation of the plunger assembly which consists of the plunger handle, plunger shaft and retaining cage against the bristles of a pair of parallel scrubbing brushes.

Another important object of the golf ball, golf club and golf shoe scrubber is the provision of means for securing the scrubbing brushes in their appropriate resting positions within its body.

Another important object of the golf ball, golf club and golf shoe scrubber is the provision of means for easily and quickly removing or replacing the scrubbing brushes.

Another important object of the golf ball, golf club and golf shoe scrubber is the provision which is the unique concave curvature of the bristles of the scrubbing brushes which face each other and provides sufficient space for vertical movement of the golf ball held in the retaining cage, yet allowing contact the bristles with the surface of the golf ball for effective cleaning action.

A further object of the golf ball, golf club and golf shoe scrubber which may or may not be present is the provision of several rows of similar length bristles located at the bottom end or base of each scrubbing brush and provides said brush the means to thoroughly clean all normal or odd shaped golf clubs in a short time with little effort.

A still further object of the present invention is the provision of the golf ball, golf club and golf shoe scrubber which is its unique appearance and construction, lightweight, simple and easy to operate, convenient to transport or carry, and highly effective for its intended purpose of cleaning golf balls, golf clubs and golf shoe cleats and soles.

The said objects with other objects and advantages will become subsequently apparent from in the details of the unique construction and operation as more fully hereinafter described and claimed, reference being made to the accompanying drawings forming a part hereof, wherein like numerals refer to like parts throughout, and in which:

Figure 1:
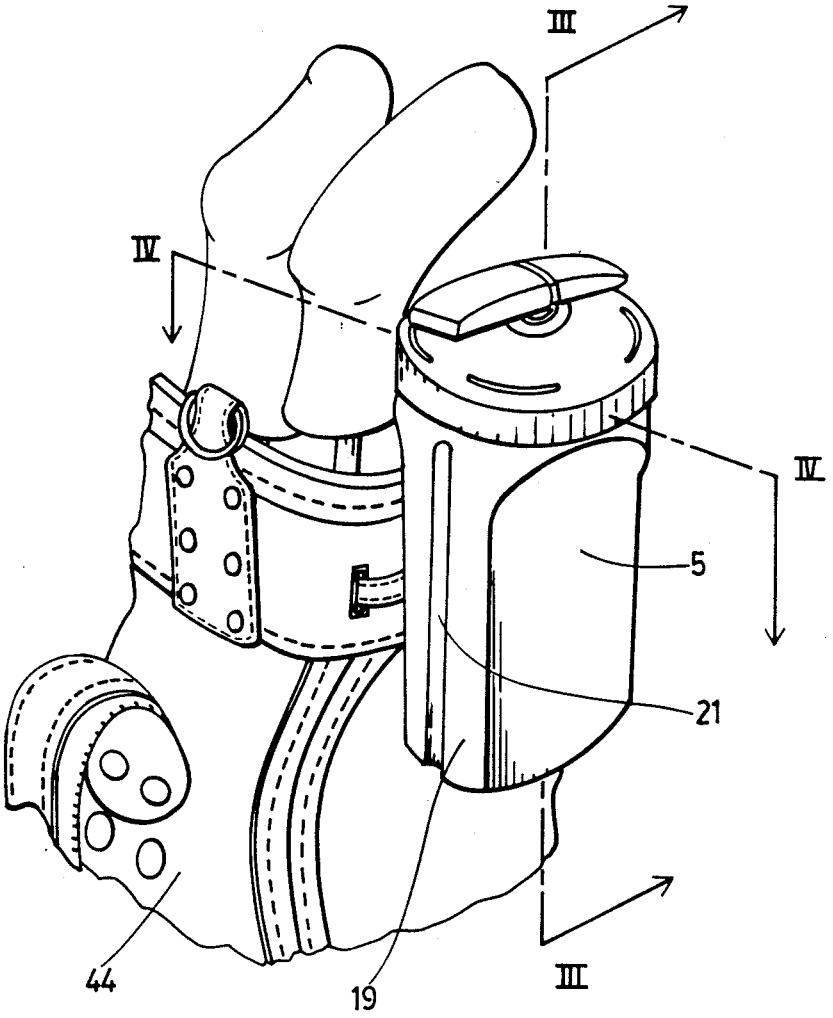
FIG. 1 is a perspective view of the golf ball, golf club and golf shoe scrubber of the present invention mounted in position upon the upper edge of the golf bag.
Figure 2:
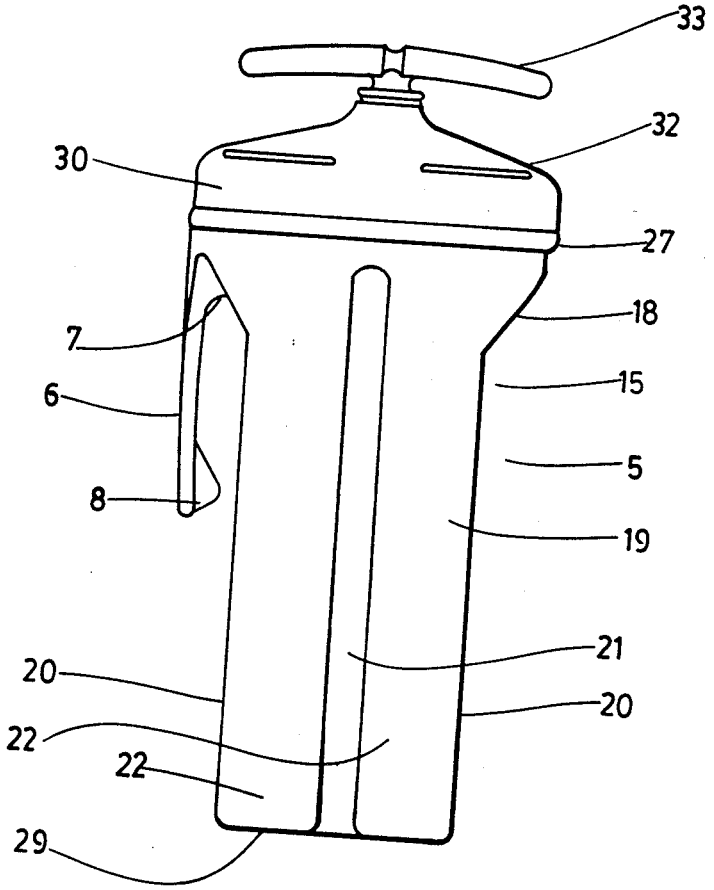
FIG. 2 is the side view minus the golf bag, clubs and golf accessories; taken along the view plane 1 in FIG. 1.
Figure 3:
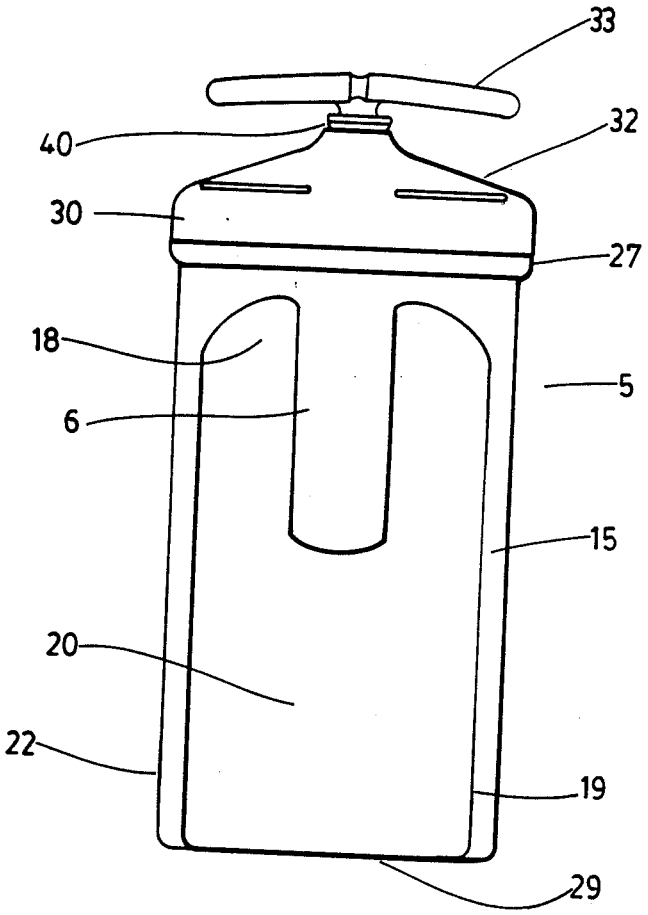
FIG. 3 is the back view minus the golf bag, clubs and golf accessories; taken along the view plane 2 in FIG. 1.
Figure 4:
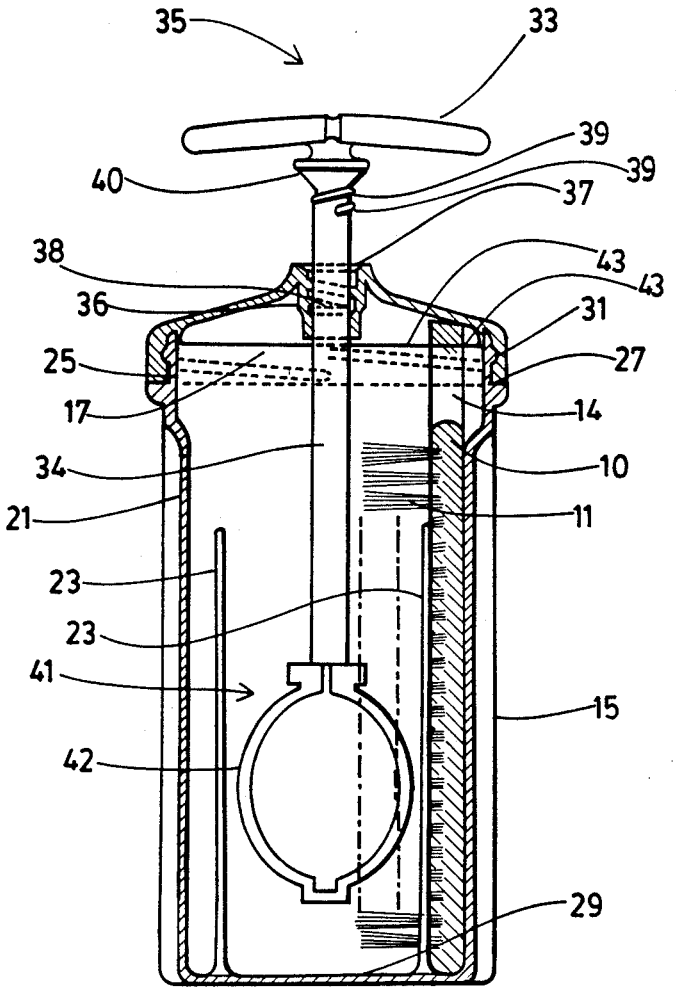
FIG. 4 is the cross-sectional view taken along the plane passing along line 3—3 in FIG. 1; one of the brushes being removed for clarity.

The golf ball golf club and golf shoe scrubber referring now particularly to the drawings, reference numeral 5 generally designates the golf ball, golf club and golf shoe scrubber comprising the present invention. The golf ball, golf club and golf shoe scrubber 5 secures by means of the clip 6 on the top rim or upon any suitable portion of the golf bag 44 edge or cart or golf vehicle.

The golf ball, golf club and golf shoe scrubber 5 consists of basically of the uniquely shaped body 15 having a closed bottom 29 and is circular at the upper portion of the body 16, and open ended 17, with the portion 25 of the body 15 adjacent the upper end 25 being threaded, and a thick raised horizontal ridge 26 extending outward below threaded section 25, to form a flat seal 27 to seat with cap 30 when threaded tight forming a Waterproof seal. The top or cap 30 being circular and having a depending peripheral flange 31, threaded complementary to the threaded portion 25, is provided so as to completely enclose the golf ball, golf club and golf shoe scrubber body 15 whereby any leaking or spilling of a cleaning solution 46 within the said scrubber 5 is prevented.

The golf ball, golf club and golf shoe scrubber 5 consists of basically of the body 15 formed of plastic or composites or metal and is circular at the upper portion of the body 16 then below which is a zone of inward transition 18 at two sides of the body 15, terminating in a curved rectangular shape with smooth curved corners 19 and two wide flat faces 20 that occur at the ¾ height level, to extend down to the base of the enclosed bottom 29. The long concave depression 21 may or may not be added, which extends down the length of the body 15, along both narrow flat surfaces 22 adding rigidity to the body, supports the brushes 10 and enhances the overall appearance of the golf ball, golf club and golf shoe scrubber.

The golf ball, golf club and golf shoe scrubber 5 consists of basically of the body 15 circular at the upper portion of the body 16 below which is a zone of transition 18 at two sides of the body 15 whereby the clip or clasp 6 extends down one side of the transition zone 18 and terminates at the mid-section region of the large flat face 20. The clip 6 is wide and lOng to securely fasten the golf ball, golf club and golf shoe scrubber 5 to the golf bag 44 or golf cart or golf vehicle. Beneath the clip 6 in the zone of transition 18, the radius of curvature 7 from the body to the clip is smooth to obtain added strength and flexibility to the clip, for easy clipping or removal of the golf ball, golf club and golf shoe scrubber 5 from its place of attachment, without danger of breakage of the clip from the scrubber body 15. The radius 7 is sufficiently wide to ensure the clip 6 can easily slip over the thick rim of the golf bag 44. Beneath the lower end of the clip 6 a raised ridge 8 adds an extra measure of interference to firmly retain the golf ball, golf club and golf shoe scrubber 5 on the golf bag 44, or cart, or golf vehicle.

The golf ball, golf club and golf shoe scrubber 5 within it a pair of brushes 10 that extend the length of the narrow body 22, having a plurality of scrubbing bristles 11 embedded on one face of each brush 10. The concave surface 12 of the bristles 11 of each brush directly face each other to form a circular cavity in the center of the body 15 having short bristles in the mid-section throughout the length and longer bristles as approaching the two sides 13 of the brush 10. The radius of the concave surface 12 can be smaller than the diameter of the golf ball 45. The brushes are lowered into the two sides of the narrow body 22, and held in a corresponding space defined by a set of two retaining ridges 23 one on each side that run the length of the face 20. The retaining ridges 23 securely hold the brushes in position within the body of the scrubber 5.

The golf ball, golf club and golf shoe scrubber cap or top 30 may or may not be dome shaped 32. The dome shape 32 would allow more room for the fingers to grasp the plunger handle 33 and operate the plunger mechanism 35, consisting of the assembly of the following parts, plunger handle 33, plunger shaft 34, retaining cage 41, and associated parts; without pinching or bruising the fingers on the cap 30. In the center of the cap 30 a sleeve 36 extends down forming a hole 37 to align the plunger shaft 34 parallel to the body 15 when cleaning. The extended sleeve 36 holds back the cleaning solution that may be carried up the plunger shaft 34 during the cleaning cycle. The internal wall of the sleeve 36, having a depending peripheral flange 37 threaded complementary to the threaded portion 38 on the plunger shaft 34, is provided so as to completely enclose the golf ball, golf club and golf shoe scrubber 5 whereby any leaking or spilling of a cleaning solution 46 within said scrubber is prevented. A conical section 40 may or may not be added below the plunger handle 33, above the plunger shaft threads 38, performing further seal to the cap 30 when screwed tight. The plunger shaft 34 is rigid, extends down parallel to the body 15. A gasket or sealing ring 43 is provided between the upper threaded portion 25 of member body 15 and the top or cap 30 so as to properly seal the cleaning solution 46 within the golf ball, golf club and golf shoe scrubber 5 when not in use, or during the golf ball cleaning process.

The golf ball, golf club and golf shoe scrubber 5 retaining cage 41 attaches to the end of the plunger shaft 34. The golf ball 45 is held in scrubbing contact with the bristles 11 by the cage 41 which has a dimension slightly more than the diameter of a standard golf ball 45 so as to resiliently retain a standard golf ball 45 and allow rotation of a standard golf ball 45 to expose new surface for cleaning. The cage 41, a basket structure of flexible plastic or composite or metal, has three or more arms, or two or more loops to form an oval or round cage 41. The cage 41 requires resilience to retain a standard golf ball 45 within its framework and sufficient flexibility to allow easy access to insert or remove a standard golf ball 45 from the cage 41. The standard golf ball 45 is smaller in diameter than the cage 41 and equal to or larger than the brush radius 12. The bristle curvature 12 provides the means to rotate the standard golf ball 45 within the cage 41 when operated by vertical manipulation of the plunger mechanism 35.

Figure 5:
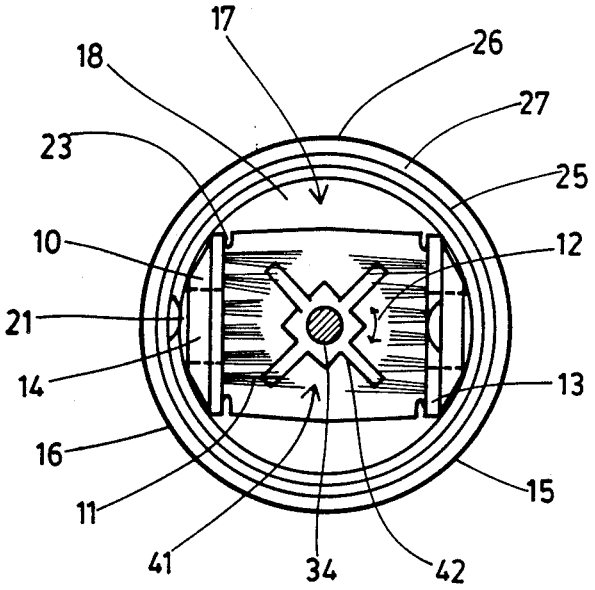
FIG. 5 is the cross-sectional view taken along the plane passing along line 4—4 in FIG. 1; the cap being removed for clarity.
Figure 6:
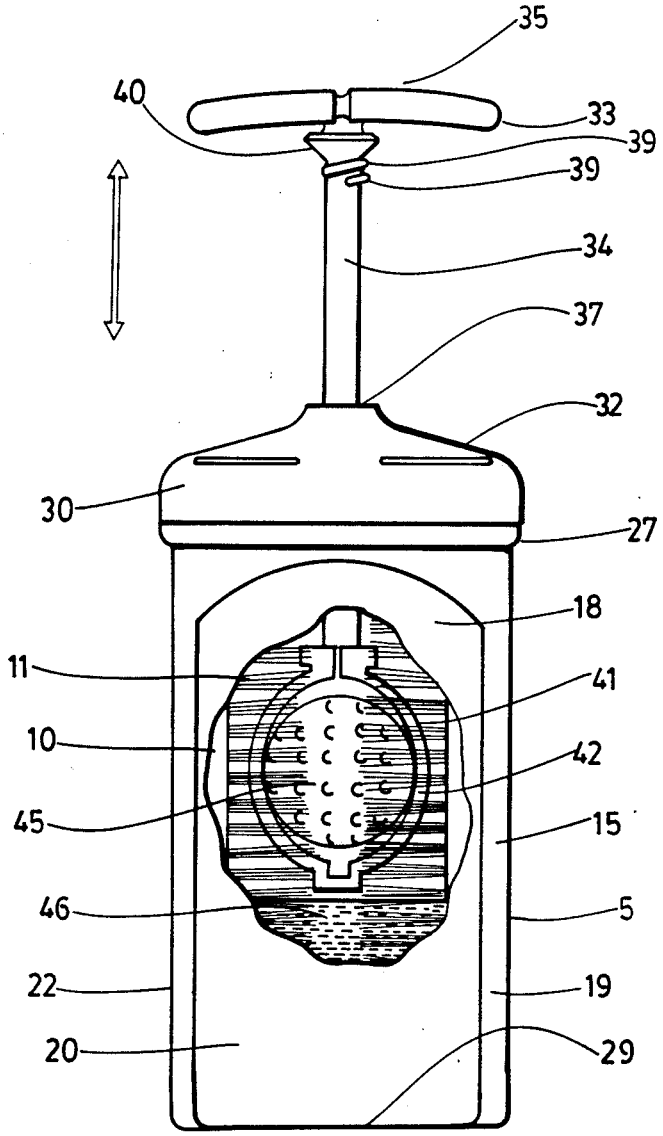
FIG. 6 is an elevational view illustrating the manner in which the golf ball, golf club and golf shoe scrubber of the present invention is operated. A portion of the front view of the flat side of this figure is broken away so to illustrate the manner in which the golf ball in the retaining cage comes in contact with the scrubbing bristles during the cleaning process.

From the foregoing, it is quite apparent a novel and ingeniously designed and engineered golf ball, golf club and golf shoe scrubbing device has been defined. The said present invention is designed to secure quickly and directly to the golf bag 44, or golf cart or motorized golf cart or golf vehicle in a variety of positions and easily accessible when required by the golfer. The golf ball, golf club and golf shoe scrubber 5 retains the water, and/or cleaning solution and/or detergent in a completely sealed manner until the golfer desires to utilize the said scrubber 5 to clean a golf ball 45 and/or golf club and/or golf shoe cleats and soles. The cleaning procedure is relatively simple and requires very little time to effectively clean the golf ball 45. The following steps are performed; first unscrew to release the cap 30, lift and remove the cap, plunger and retaining assembly which make up the plunger mechanism 35 from the said scrubber body 15, insert the golf ball 45 within the cage 41, return the cap 30 and plunger mechanism 35 to the scrubber body 15 and screw tightly, then unscrew to release the plunger assembly 35 by the turning plunger handle 33, grasp the plunger handle 33 and maintain a vertical up and down force to allow the golf ball 45 that is loosely held within the cage 41 to rotate as it is scrubbed between the sets of brushes 10 with the concave curved bristles 12 as illustrated in FIG. 5. Subsequently upon completion of the scrubbing operation, screw and secure the plunger mechanism 35 to the cap 30 by turning the plunger handle unscrew and lift the cap 30 and plunger assembly 35 from the body and remove the clean golf ball 45 from the cage 41. Return and screw the cap 30 to the scrubber body 15 to effectively seal the container to prevent leakage of the cleaning solution.

The golf ball, golf club and golf shoe scrubber 5 has two brushes 10 that when desired can be easily removed from the said scrubber 5 simply by unthreading and removing the cap 30 and plunger assembly 35 from the scrubber body 15 and grasping the brush 10 soaked in cleaning solution 46, through the hole 14 or other fixture for removal and pull it out to scrub the golf clubs and/or golf shoe cleats and soles clean. The several rows of similar length bristles 11 at the bottom end of the brush allow easy cleaning of normal or odd shaped golf clubs and/or golf shoe cleats and soles and the brush 10 can be repeatedly immersed into the cleaning solution 46 to remove stubborn dirt or grime from the clubs, golf shoe cleats or soles. After cleaning the brush 10 is replaced within its nested location in the scrubber body 15 and the plunger assembly is ready to accommodate a golf ball 45 for cleaning or secured with the cap 30 onto the scrubber body 15 to properly seal the cleaning solution 46 within the golf ball, golf club and golf shoe scrubber 5 when the scrubber is not in use.

The present invention is not specifically limited to any one material, as there are various types of plastics or composites or metals that are suitable for its construction.

The foregoing characterization is considered as illustrative only of the principals of the said invention. Furthermore, since numerous modifications and design changes will readily occur by other parties, thereto the intent is not to limit invention to the exact appearance, construction and operation shown and described. Accordingly all suitable and similar modifications and equivalents may be exercised to, falling within the scope of the invention as claimed.

What is claimed as new is as follows:

1. A golf ball washing device comprising:

an elongated container for cleaning liquid having a lid at one end, the lid being engagable on the container in a liquid tight manner and being removable to allow access to the container for a golf ball;

an axial longitudinal shaft in the container mounted to project through the lid for reciprocal longitudinal movement, a seal against liquid leakage between the lid and the shaft;

a cage for the golf ball mounted at an inner end of the shaft within the container, the cage comprising a plurality of resiliently deformable elongate members connected at their ends and shaped to form a generally spherical enclosure for the golf ball, whereby the golf ball is insertable into the cage by resilient deformation of the members;

a handle on the outer end of the shaft outside the container;

a pair of elongate brushes each comprising a base having bristles extending forwardly therefrom, the pair of brushes being arranged on opposite sides of the shaft and cage with the bristles of each brush directed towards the shaft and cage, the length of the brushes extending over at least a major portion of the length of the container, the bases of the brushes being releasably engaged in tracks located on an inner wall of the container, whereby the brushes are removable from the container when the lid is removed.

2. A golf ball washing device as claimed in claim 1, in which the bristles of each brush of the pair of brushes are contoured in a semi-cylindrical shape to conform with the shape of the golf ball.

3. A golf ball washing device as claimed in claim 1, in which each track comprise a pair of first ribs each projecting from the iner wall to extend about a longitudinal margin of the respective brush.

4. A golf ball washing device as claimed in claim 3, including a further longitudinal rib projecting from the inner wall between each pair of first ribs to bias the respective brush towards the respective pair of first ribs.

5. A golf ball washing device as claimed in claim 1, including a clip for attachment to a golf bag.

* * * * *